United States Patent [19]

Lautzenheiser

[11] 4,369,436

[45] Jan. 18, 1983

[54] ANTI-BRIDGING CABLE SUPERVISION CIRCUIT

[75] Inventor: William J. Lautzenheiser, North Billerica, Mass.

[73] Assignee: American District Telegraph Company, New York, N.Y.

[21] Appl. No.: 259,661

[22] Filed: May 1, 1981

Related U.S. Application Data

[63] Continuation of Ser. No. 87,317, Oct. 22, 1979, abandoned.

[51] Int. Cl.[3] ..... G08B 29/00

[52] U.S. Cl. ..... 340/506; 340/507; 340/508; 340/510; 340/511

[58] Field of Search ..... 340/506–511, 340/500, 533, 537, 538, 657, 660–664; 330/267, 290, 296, 301, 117, 127, 133–136, 147; 179/5 R, 5 P, 81 E; 178/69 R, 69 A, 69 G

[56] References Cited

U.S. PATENT DOCUMENTS

| | | | |
|---|---|---|---|
| 3,142,019 | 7/1964 | Favin | 330/301 |
| 3,530,378 | 9/1970 | Holle et al. | 340/661 |
| 3,534,353 | 10/1970 | Calkin et al. | 340/661 |
| 3,641,547 | 2/1972 | Reiss et al. | 340/511 |
| 3,702,473 | 11/1972 | Fink | 340/511 |
| 3,786,501 | 1/1974 | Marnerakis | 340/511 |
| 3,866,202 | 2/1975 | Reiss et al. | 340/511 |
| 3,980,995 | 9/1976 | Vasquez | 340/511 |

*Primary Examiner*—John W. Caldwell, Sr.
*Assistant Examiner*—Donnie L. Crosland
*Attorney, Agent, or Firm*—Weingarten, Schurgin, Gagnebin & Hayes

[57] ABSTRACT

In an intrusion alarm system, an anti-tamper system for detecting the bridging and removal of sensors connected in parallel along an interconnection cable includes means at each sensor for detecting open circuits on or shorting between any of the lines of the cable. Each sensor is provided with a resistance element and the resistance elements are connected in series by virtue of connection to the cable. Should any of the lines be cut or shorted, regardless of any bridging attempt to remove the sensor from operation, this condition is sensed and the series connection for the resistors is interrupted. This causes an imbalance at the comparator utilized to sense the combined impedances of the resistance elements and an alarm condition is indicated. If an attempt is made to bridge the line connecting the resistors together, the removal of the bridged resistor also causes an imbalance at the comparator which results in an alarm indication.

10 Claims, 5 Drawing Figures

ANTI-BRIDGING CABLE SUPERVISION CIRCUIT

This is a continuation, of application Ser. No. 087,317, filed Oct. 22, 1979, now abandoned.

FIELD OF INVENTION

This invention relates to intrusion alarm systems and more particularly to a system for supervision of the signal conditions of the cable interconnecting a central control unit and one or more remote sensors in which bridging and/or tampering with the interconnect cable is sensed and an alarm condition is indicated.

BACKGROUND OF THE INVENTION

Intrusion alarm systems are known for detecting the presence of an intruder in a zone under protection. In such systems, there is typically provided a central control unit and a plurality of sensors, each located at an area to be protected, the sensors being interconnected by one or more multi-wired cables to the control unit. Typically, the sensors each include some means for detecting a predetermined condition, such as intrusion, waterflow, temperature, etc. The central control unit includes signal processing circuitry for detection of alarm signals indicating intruder presence.

While various systems have been suggested to detect intruder presence, and while various systems have been devised to prevent tampering with the system, such as sensor interlock switches to protect against dissembling the sensor, it is often times possible to defeat the intrusion alarm system by merely bridging the cable fore and aft of a particular sensor and then cutting the wires to the sensor between the bridge points so as to cut out the particular sensor. This effectively removes the particular sensor from the intrusion alarm cable supervision circuit and its absence is not readily ascertainable at the central control unit.

The defeating of the alarm system in this manner is possible when the sensors are connected in parallel along the interconnect cable.

For purposes of this application bridging refers to providing a conductive path or wire from a point just prior to a particular sensor to a point just aft of the sensor. Once this bridge has been established, it is then possible to cut out and remove the particular sensor from the system.

SUMMARY OF THE INVENTION

In order to prevent this type of action from defeating the system, in the subject invention each sensor is provided with a specialized circuit, called a line integrity sensing unit, which senses either the opening or shorting of any of the interconnect wires utilized the transmission cable. All of the interconnect wires to each sensor are coupled to this unit so that their condition can be sensed. In one embodiment, the relative signal strengths between all of the interconnect wires are monitored and should there be any change in the relative amplitudes of the signals on these wires, either by shorting or by severing, then the line integrity sensing unit produces an output signal. This output signal is utilized to interrupt a circuit which is comprised of a number of serially connected resistors, with each sensor being provided with a resistor. When the sensors are connected to the transmission cable, the resistors are serially connected. The serially connected resistor network when led back to the central control unit, in effect, is part of a voltage dividing network which determines the voltage on one terminal of a comparator circuit. The other terminal of the comparator circuit is provided with a manually adjustable voltage and the system is set up such that with complete line integrity the voltages at each of the terminals of the comparator are equal. When these voltages are equal, the output of the comparator is zero and no alarm condition is indicated.

Should the line integrity sensing unit detect a lack of integrity in any of the lines, due to the cutting or shorting of any of the lines, then the serially connected resistor circuit is opened and there is a voltage imbalance at the comparator. The comparator circuit is utilized to actuate an alarm indicator for indicating that a bridging and/or cutting operation has proceeded responsive to a sensed imbalance.

In one instance, bridging alone can be detected, assuming that the bridging occurs across the terminals which form part of the serially connected resistor network. In this case, bridging the circuit shorts the resistor associated with the sensor to be bridged out. This, in turn, causes a voltage imbalance at the comparator and an alarm condition is indicated.

In the subject invention, the provision of the anti-bridging circuitry does not affect the usual AC operation of the sensors and may be added as an adjunct to virtually any multi-cable intrusion alarm system.

Additionally, if tamper switches normally utilized to prevent tampering with the sensor are connected in series with the serially connected resistors, then the same circuit which is utilized for case tampering can also be utilized for the serially connected resistor string, and case tampering may be indicated by comparator imbalance.

In terms of the line integrity checking circuit, in one embodiment this circuit incorporates means for sensing peak-to-peak carrier voltage if a carrier is used in the sensing circuit, means for sensing the presence or absence of control or command signals, and of course, the presence or absence of power.

With respect to the initializing and setting of the centralized control unit, in one embodiment rather than utilizing a single comparator circuit, a series of four comparator circuits are utilized, with a set comparator circuits utilized to drive an alarm relay and a different set of comparator circuits utilized with a light indicating device to initially set up the system and establish the proper balance.

In this embodiment, pairs of comparators are utilized in the initial setting of the potentiometer which controls the balance, such that when the light indicating device goes out, the exact balance is indicated. Another pair of comparators is then automatically set, which second set of comparators drives the alarm relay. Because of a voltage divider network utilized in establishing the balance of the pairs of comparators, the second set of comparators is considerably less sensitive to minor variations in voltage swings at the inputs of the comparators than the first set. This reduces the false alarm rate for the system. The false alarm rate can be exceedingly high due to weathering of the cable and other extraneous factors which cause the resistance of the cable to vary over time and temperature.

DESCRIPTION OF THE DRAWINGS

The invention will be more fully understood from the following detailed description taken in conjunction with the accompanying drawings in which.

DETAILED DESCRIPTION

Figure 1:
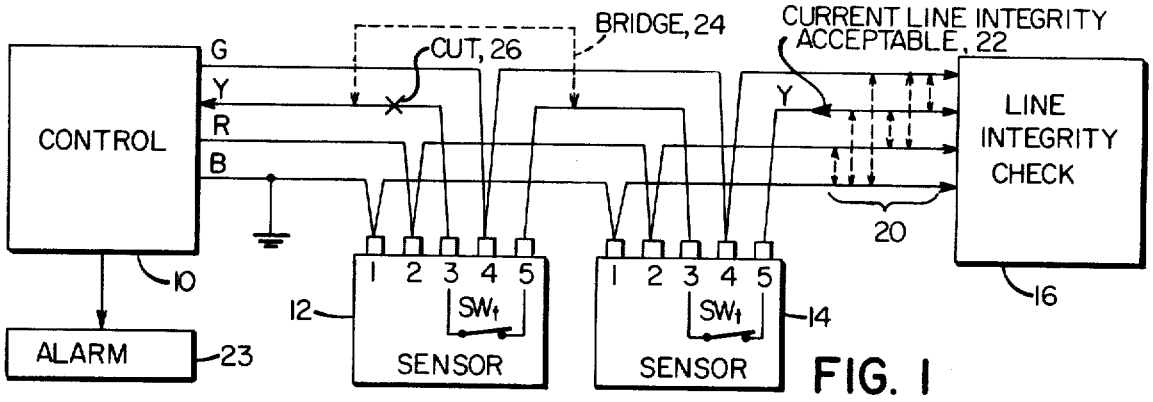
FIG. 1 is a block diagram of an intrusion alarm system utilizing a multi-cable interconnect illustrating the effect of bridging and/or cutting of the interconnect cable about a given sensor.

Referring now to FIG. 1, a typical intrusion cable alarm supervision system is illustrated in which a centralized control unit 10 is coupled by a multi-cable interconnect system, in this case employing four lines, to a number of sensors 12 and 14. Each of the sensors is coupled in parallel across the four lines. For ease of explanation, the bottom line is labeled the black line, B; the next line up, the red line, R; the next line to the top line, the yellow line, Y; and the top line green, G. In general, the black line is the ground line, the red line is utilized for power, the green line is utilized for D.C. command signals, and the yellow line is utilized to provide a carrier to the sensors and also for returning A.C. signals indicating a sensed intrusion.

In one type of system, a line integrity checking unit which is the end unit, here illustrated at 16, is utilized to check the integrity of all the lines coming into it. This checks for expected signals on any of the lines, such as amplitudes, so that any predetermined deviation between the lines as indicated by arrows 20 will be sensed. Upon such an occurrence, a current transmitted back on the green line is interrupted should any lack of line integrity be sensed. The direction of the current is illustrated by arrow 22.

Tamper switches $SW_t$ are interposed between terminals 3 and 5 of the tensor units such that if the sensor case is breached, these switches open, which automatically interrupts the current on the green line, thus indicating an alarm condition at alarm indicator 23.

Figure 2:
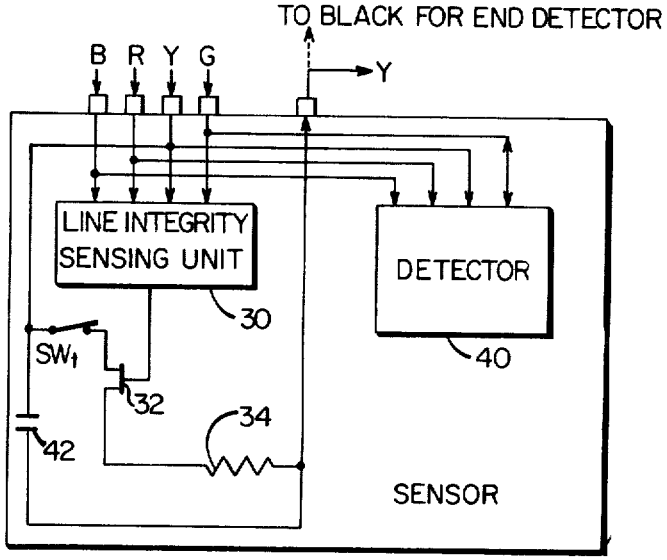
FIG. 2 is a block diagram of an individual sensor illustrating a line integrity checking circuit which is utilized in connection with a serially connected resistor element to provide an indication of bridge-type tampering.

As mentioned hereinbefore, it has been possible for one who wishes to defeat the intrusion alarm system to bridge the lines fore and aft of a particular sensor and then cut the lines between the bridge points so as to effectively remove the sensor from the system without being detected. Such a bridging condition is illustrated by dotted line 24. In this example a cable is connected fore and aft of sensor unit 12 on the yellow line. After the bridge has been installed the yellow line is cut as illustrated at 26 thereby presumably removing sensor 12 from the system. In order to prevent the defeating of the system by such a tactic, each sensor in the subject system is provided with a line integrity sensing unit 30 as illustrated in FIG. 2. Each of the wires in the interconnect cable is connected to the line integrity sensing unit and its output is utilized to position a switch, in this case a field effect transistor 32, so as to turn this switch OFF should line integrity be compromised.

Each sensor is provided with a resistive element, here illustrated at 34, which is connected in series between the yellow line terminal, in this case terminal 3, the tamper switch $SW_t$, the field effect transistor 32, and terminal 5 of the sensor. Thus, each sensor may be given a characteristic resistance which when the sensors are connected in series, would indicate line integrity.

It will be appreciated that a detector 40 may be coupled in parallel with a line integrity checking unit. The detector operates in a normal fashion to generate an alarm signal on the yellow line should intrusion be sensed.

Note that a capacitor 42 may be utilized to shunt sensor carrier signals around the anti-bridging circuit, with the capacitor 42 being connected between terminal 3 and terminal 5 of the subject circuit.

When sensors of the type illustrated in FIG. 2 are utilized it is not necessary to have a line integrity checking circuit as an end element. Rather, the last sensor has a jumper pin between terminal 5 and terminal 1 which connects the serially connected resistor string to ground and thus back to the control unit.

Figure 3:
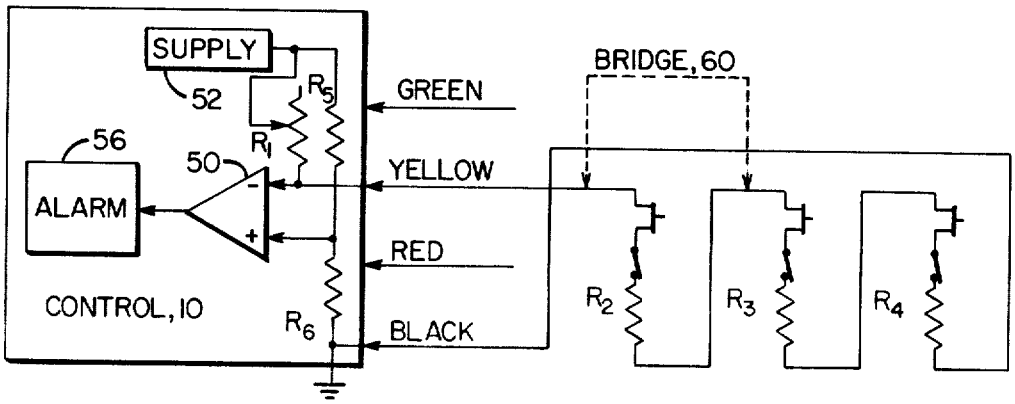
FIG. 3 is a schematic diagram illustrating the serially connected resistor circuit for indicating a bridge type tampering situation.

Such a situation is diagramatically illustrated in FIG. 3 in which resistors R2, R3 and R4 are serially connected via the corresponding FETs and tamper switches back through the black ground wire.

As to the central control unit 10, this unit may be provided with a comparator 50 which has inverting and non-inverting inputs. This comparator is provided with a supply voltage at 52 in which a predetermined voltage is applied through resistor R1 to the inverting input terminal. It will be appreciated that R1 in combination with R2, R3 and R4 provides a voltage dividing circuit such that with all resistors in the loop, a predetermined voltage will appear at the inverting input terminal to the comparator. A voltage dividing circuit comprising potentiometer R5 and resistor R6 provide an adjustable voltage to the non-inverting input terminal to the comparator. The wiper arm 94 of the potentiometer R5 is coupled to supply 52.

The output of comparator 50 is applied to a suitable alarm indicating circuit 56 such that when the comparator output is zero no alarm is indicated whereas when the comparator output deviates from zero, the alarm is actuated.

In operation, potentiometer R5 is set such that the voltage at each of the input terminals to the comparator is equal. Comparators are such that when equal voltages appear at their input terminals, the output of the comparator is open circuited. When a predetermined voltage imbalance is exceeded, the output terminal of the comparator changes state. Such a comparator is available commercially as model LM 339 from National Semiconductor.

Taking for example the condition in which one of the sensors is bridged as illustrated by dotted line 60 it will be apparent that resistor R2 is removed from the circuit. This causes an imbalance in the voltages at the comparator and the comparator is then utilized to actuate alarm 56. Thus, alarm 56 is actuated regardless of whether the line integrity checking circuit of the FIG. 2 is actuated by interline shorts or open circuits. Thus "early warning" of a disable attempt is provided. Assuming the yellow line is not bridged and the other lines are bridged, then immediately upon cutting any of the lines to disable the sensor the corresponding FET will open up which interrupts the resistor string circuit. At this point, an alarm condition is indicated due to the massive voltage imbalance occuring across the input terminals to the comparator.

Figure 4:
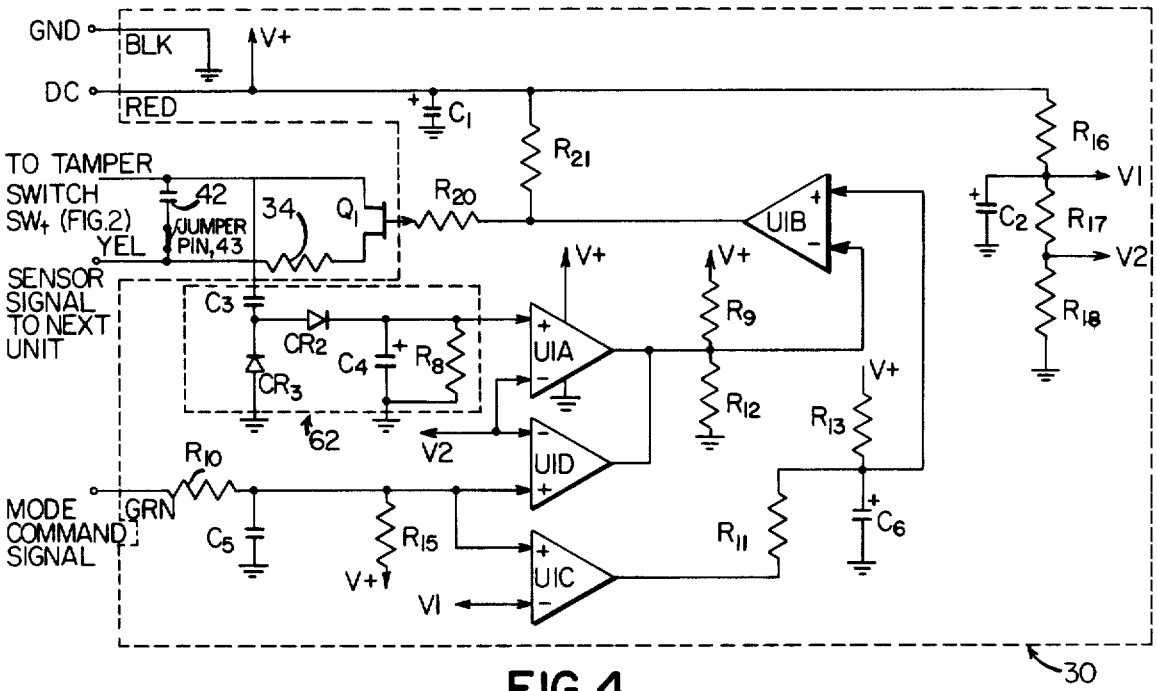
FIG. 4 is a detailed schematic diagram of the line integrity checking unit; and, FIG. 5 is a schematic diagram of one type of comparator circuit which may be utilized in the centralized control unit to initialize the subject system and to provide a detection window within which the system is non-responsive.

Referring now to FIG. 4, line integrity sensing unit 30 of FIG. 2 may take on the configuration illustrated. In this case, the ground, D.C. sensor and mode command signal lines are coupled to the unit as illustrated. This unit responds to an interruption or cutting of any one of the lines to the unit or the shorting of any one line to any other line to the unit.

As mentioned hereinbefore, the black line is the ground or return line for the system, the red line is the DC power line, the yellow line is the sensor line and in one embodiment carries a 26 kilohertz signal. The green line serves a variety of functions including those of providing mode command signals. In one embodiment, these may be tri-level mode command signals corresponding to a RESET command, a LATCH command or a FREEZE command.

Unit 30 is provided with a series of four comparators of the type described before which provide predetermined output when the input voltages thereto are equal or within a predetermined range and in which the output state is reversed when this range is exceeded. These comparators are labeled U1A–U1D for convenience. Under normal circumstances when there is no tampering indicated, the output of U1B is grounded which turns FET $Q_1$ ON. This transistor can serve as FET 32 of FIG. 2. Should tampering of the type described above occur, the output of comparator U1B is open-circuited, causing $Q_1$ to return to a nonconducting state, thereby providing an indication that tampering has occurred.

Referring now to the operation of the comparators, V+ from the control unit is applied to the divider, R16, R17, and R18, where the DC voltages V1 and V2 are developed. The values of the three resistors are such that V1 falls between the levels of the mode command signals for LATCH and FREEZE, and V2 falls below the level of the FREEZE command signal, but above ground.

The incoming carrier is applied to a peak-to-peak detector 62 consisting of C3, CR3, CR2, C4 and R8, with the resulting DC output from this detector applied to the +input of the voltage comparator U1A. Since the −input of U1A is held at the low DC voltage, V2, the U1A output will be open-circuited as long as the sensor carrier signal is present. If a cut or short-circuited wire, or an open tamper switch should prevent the sensor carrier signal from appearing at the detector input, the voltage at the +input of U1A would collapse to ground, and the U1A output would then be grounded.

The tri-level mode command signal with periodic FREEZE pulses is applied, via R10 and filter capacitor C5 to the +inputs of both U1D and U1C. Due to its high resistance, the R15 connection to V+ will have essentially no effect on the DC level of the command signal. With the −input of U1D held at V2, the U1D output will be open-circuited as long as any of the three mode command signals is present. With the −input of U1C held at V1, however, above FREEZE but below RESET or LATCH, the U1C output will be open-circuited whenever a LATCH or RESET command signal is present, and will be grounded whenever a FREEZE command is present.

If the command signal line should be short-circuited to ground, both the U1D and U1C outputs would be grounded. It is the grounded U1D output that is significant in responding to this problem. In order for $Q_1$ to remain ON, the −input of U1B must be at one-half V+, as determined by the divider R9 and R12. This occurs only when the outputs of both U1A and U1D are open-circuited, and requires both the presence of the sensor carrier and any one of the three command signals, e.g., a DC voltage greater than V2.

Conversely, if the command signal line should be open-circuited or cut, current through R15 would charge C5 to V+, causing both the U1C and U1D outputs to be open-circuited. It is the open-circuited U1C output that is significant in responding to this problem. In order for $Q_1$ to remain ON, the +input of the U1B must be less than one-half V+ that is normally at the −input. If the command signal line is cut so that C5 charges to a high level, and there are no FREEZE pulses, the U1C output will remain open-circuited continuously, allowing C6 to charge to V+ through R13. It will be shown later that this situation will prevent $Q_1$ from turning ON.

With the command signal line intact, and the system operating in the FREEZE mode, the U1C output is grounded. In this condition, the C6 charge voltage, at the U1B +input, is determined by the divider R13 and R11, and is well below the one-half V+ at the −input. With a RESET or LATCH command, the U1C output is open-circuited during the intervals between FREEZE pulses, and is grounded during the pulses. Therefore, C6 charges in the direction of +V through R13 between pulses, and discharges rapidly toward ground during pulses. The values of R11, R13 and C6, and the FREEZE pulse repetition rate and duty cycle are such that the voltage at the +input of U1B is always less than the one-half V+ that is normally present at the −input of U1B. Note it is important that the freeze command signals be of the appropriate amplitude and in the case of pulses, they are to have a uniform repetition rate and pulse width. Also in one embodiment freeze pulses are always present. Therefore, with a proper FREEZE command signal, or a proper RESET or LATCH command signal containing FREEZE pulses, $Q_1$ will be rendered conductive.

It has been shown that with the proper sensor carrier and command signals present at the tamper module inputs, the −input or U1B is at one-half of V+, and the +input voltage is less than the −input. In this condition, the U1B output grounds resistor 20, rendering $Q_1$ conductive.

If, due to tampering, the proper signals do not appear at circuit 30, the voltages at the U1B inputs will be such that its output will be open-circuited. With no ground return for R20 the gate of $Q_1$ will be biased OFF by V+. The turning OFF of $Q_1$ will then be sensed by the control unit to indicate that there is a fault somewhere in the system integrity.

Note that for the last of the sensors, jumper pin 43 is removed and the sensor signal output from resistor 34 is connected to the ground wire.

Figure 5:
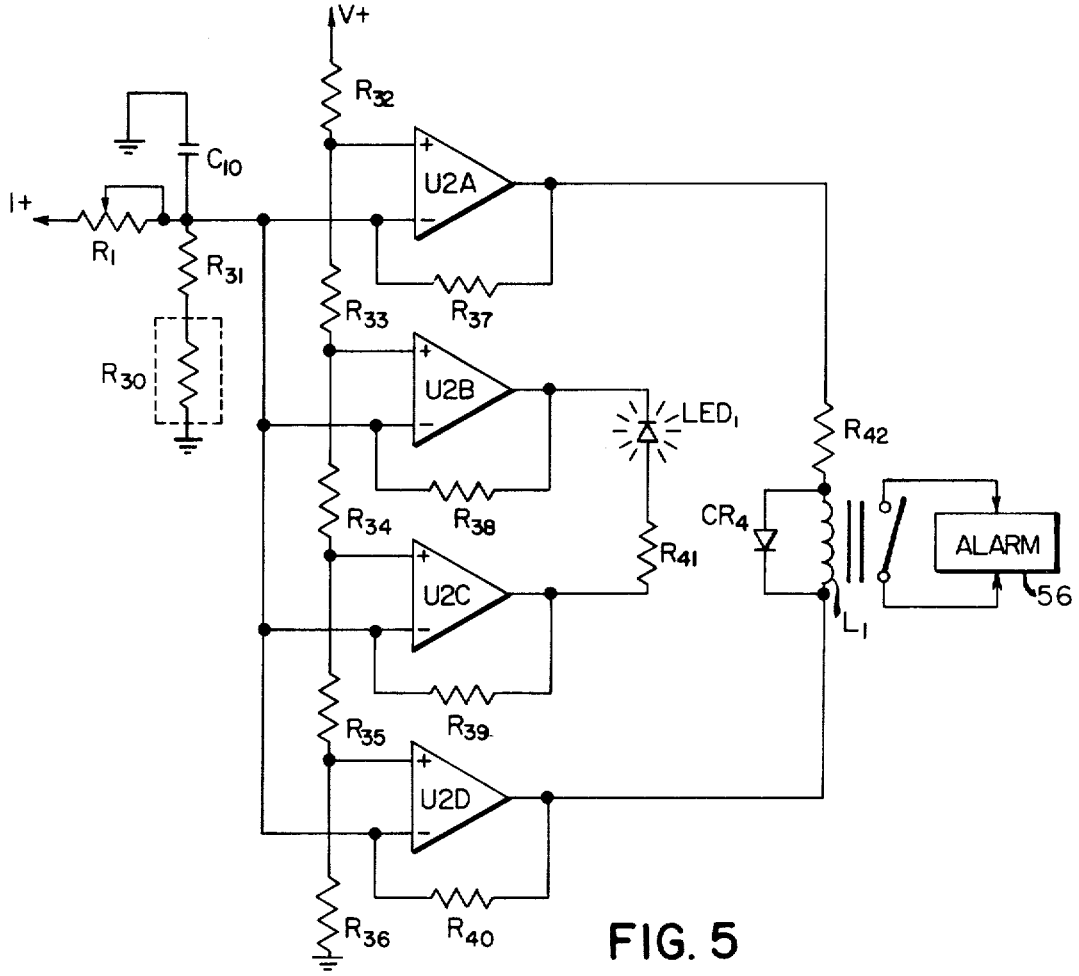

Referring now to FIG. 5, a comparator circuit with built-in feedback and easily adjustable balance is illustrated in which pairs of comparators are utilized to drive an LED display, $LED_1$, and the alarm relay respectively. In this figure, the aforementioned resistor string is represented by a single resistor R30 and R1 is the adjustment potentiometer of FIG. 3. R31 is inserted between R1 and R30 to aid in the adjustments for the resistor string. One end of R30 is applied in parallel to the inverting input terminals of comparators U2A–U2D.

It will be apparent that the non-inverting inputs of all the comparators are tapped off a voltage dividing network composed of resistors R32 through R36 connected between V+ and ground. This string is substituted for the voltage dividing network R5 and R6 of FIG. 3. With respect to the inner pair of comparators, U2B and U2C, it is the purpose of these comparators in combination with potentiometer R1 to assure extreme accuracy in the voltage setting such that the voltage at the inverting input terminals to the comparators with all resistors R30 connected in the string, balances out the supply voltage applied to the non-inverting input terminals. The utilization of these inner comparators permits this setting within a few tenths of a percent and operates as follows: With voltages tapped from the voltage dividing network R32–R36 at the non-inverting input terminals to U2B and U2C and with R33 through R35 being 1 K resistors in one embodiment, the voltage difference between that applied to the non-inverting input terminal of U2B and that applied to the non-inverting terminal of U2C is determined by the 1 K resistor R34. Thus, when the voltage available at the inverting input terminal is larger than the voltage established by the voltage drop across R34 one of the differential amplifiers will have a grounded output terminal, while the other will have an open output terminal. What this means is that one of the comparators becomes a current source while the other becomes a current sink. In this case, current will flow through $LED_1$ and resistor R41. When the voltage established by R1, R30 and R31 is smaller than the voltage drop across R34, either the outputs of both comparators will either be open or grounded. In either case, $LED_1$ is extinguished.

Thus the inner two comparators, U2B and U2C, are utilized by virtue of the extinguishing of $LED_1$ to set the voltage at all of the inverting input terminals to the comparators. This voltage setting is extremely accurate and the visual indication makes it extremely easy to initialize the system with respect to the resistors in the resistor string.

Once having initialized the inner pair of comparators, the outer pair of comparators may be utilized to drive an alarm relay coil L1, with a diode CR4 across the coil for protection. It will be appreciated that the voltage drop from the upper comparator U2A to the lower comparator U2D is the voltage drop across R33, R34 and R35. In one embodiment, this is a 3 K drop, which is less sensitive to voltage swings at the junction of R1 and R31.

In operation, there may be as many as ten resistors in the aforementioned string and the interconnect cable between the resistors back to the control unit may be as long as 1,000 to 2,000 feet. It will be appreciated that these resistors and cables are subject to changing environmental conditions including large temperature variations which, in essence, change the values of the resistors in the string. While these changes are oftentimes sufficient to cause an unbalanced condition to be indicated by the inner pair of comparators, due to the larger voltage drop between the outer pair of comparators, swings induced by temperature and moisture changes are ineffective to cause an alarm indication.

It will be appreciated that resistors R37 through R40 are feedback resistors and are inserted between the output of the comparator and the inverting input terminals.

Moreover, it will be appreciated that capacitor C10 is utilized to shunt any hum or AC signals away from the input terminal to the comparators so as to eliminate any vestige of carrier signal which may be applied at that point.

Having described above the preferred embodiment of the present invention, it will occur to those skilled in the art that various modifications and alterations can be made to the disclosed system without departing from the spirit of the invention. Accordingly, it is intended to limit the scope of the invention only as indicated in the following claims.

What is claimed is:

1. In an intrusion alarm system having a sensor connected to a multi-wire transmission line from a pair of terminals at a control unit, a method for sensing the compromising of the sensor by a bridging and cutting operation comprising the steps of:

providing a network of resistive elements, at least one resistive element per sensor and means including switches, one each per sensor, for serially connecting the resistive elements through the wires of said transmission line across said pair of terminals;

detecting at each sensor a cut or short circuit of the wires of said transmission line;

opening the switch associated with a sensor at which a cut or short of the wires of said transmission line is detected; and, monitoring the resistance of said network for changes therein, whereby a resistance change indicates either bridging of a resistive element or shorting or cutting of a wire.

2. The method of claim 1 wherein each sensor has a monitored condition detector and, wherein the switch opening step includes opening the switch at the sensor at which a monitored condition is detected.

3. The method of claim 1 wherein the monitoring step includes the step of detecting network resistance changes above a predetermined magnitude.

4. The method of claim 1 wherein the monitoring step includes the steps of monitoring the voltage drop across the resistor network with a circuit, and initially adjusting the voltage drop across the resistor network in with an auxiliary circuit which is more sensitive to resistance changes than is the circuit utilized for monitoring resistance change, whereby the monitoring circuit may be both accurately set and have a hysteresis symmetrical about the setting.

5. An intrusion alarm system comprising:

a central unit including means for indicating the presence of an alarm condition signal present at said unit, said unit having a pair of terminals;

a multi-wire interconnect cable having one end connected to said central unit;

a number of sensors connected to said cable, each sensor including means for providing an alarm condition signal responsive to a detected intrusion;

a resistor network, at least one resistor per sensor;

means including the wires of said cable for connecting said resistors in series across said pair of terminals;

means at each sensor for detecting an open or shorted wire;

means including a switch at the sensor at which an open or shorted wire is detected for interrupting at the sensor at which an open or shorted wire is detected the serial connection of said resistors responsive to the detection at said last mentioned sensor of an open or shorted wire; and, means at the two terminals of said central unit for monitoring the resistance of said network for changes therein and for providing an alarm indication upon the occurrence of a predetermined resistance change, whereby bridging or line tampering is monitored and indicated.

6. In an intrusion alarm system having a sensor connected to a multi-wire transmission line from a control unit, said control unit having a pair of terminals, apparatus for sensing the compromising of the sensor by a bridging and cutting operation:

a voltage dividing network having a number of resistive elements, at least one resistive element per sensor;

means including the wires of said transmission line for connecting the resistive elements in said voltage dividing network in series across said pair of terminals;

means at each sensor for detecting an open or shorted wire;

switch means at a predetermined sensor for interrupting at said predetermined sensor the serial connection of said resistors responsive to the detection of an open or shorted wire at said predetermined sensor; and, means for monitoring the resistance of said network for changes therein, said monitoring means including a comparator circuit for comparing a voltage at a predetermined node in said voltage dividing network with a predetermined voltage, and for providing an output signal when a predetermined voltage difference between the voltage at said node and said predetermined voltage has been exceeded, and means connected to said comparator circuit for providing an alarm indication responsive to the production of said output voltage.

7. The apparatus of claim 6 wherein said voltage dividing network includes a potentiometer, whereby the voltage at said node may be easily varied.

8. The apparatus of claim 6 wherein said node corresponds to one of said pair of terminals and wherein said second of said pair of terminals is grounded, and further including DC voltage supply means and a second voltage dividing network coupled between said supply means and ground to provide said predetermined voltage.

9. The apparatus of claim 6 wherein said comparator circuit includes an indicating device; a number of comparators, each of said comparators having one input terminal thereto coupled to said node; a voltage supply and a second voltage dividing network connected between said voltage supply and ground, said second voltage dividing network having plurality of interconnection points between the resistive elements thereof; means for connecting the other of the terminals of said comparators to different ones of said interconnection points, the comparators associated with the outer most connection points being connected to drive said alarm indication providing means and the comparators connected to the inner most interconnection points being connected to drive said indicating device, each of said comparators having a feedback resistor connected from the output thereof to the input terminal connected to said node, the resistive elements of said second voltage dividing network being given values such that the comparators which drive said alarm indication providing means are less sensitive to voltage changes at said predetermined node than are the comparators which drive said indication device, whereby the voltage at said node may be adjusted precisely in accordance with the outputs from said inner comparators and whereby said outer comparators are thereby appropriately set with hysteresis about that point set in response to the indication from said inner comparators.

10. In an intrusion alarm system having a sensor connected to a multi-wire transmission line from a control unit, said control unit having a pair of terminals, apparatus for sensing the compromising of the sensor by a bridging and cutting operation comprising:

a voltage dividing network having a number of resistive elements, at least one resistive element per sensor;

means including the wires of said transmission line for connecting the resistive elements in said resistor network in series across said pair of terminals; and, means for monitoring the resistance of said network for changes therein, said monitoring means including a comparator circuit for comparing a voltage at a predetermined node in said voltage dividing circuit with a predetermined voltage, and for providing an output signal when a predetermined voltage difference between the voltage at said node and said predetermined voltage has been exceeded, said monitoring means further including means connected to said comparator circuit for providing an alarm indication responsive to the production of said output signal, said comparator circuit including an indicating device;

a number of comparators, each of said comparators having one input terminal thereto coupled to said node;

a voltage supply and a second voltage dividing network connected between said voltage supply and ground, said second voltage dividing network having a plurality of interconnection points between the resistive elements thereof; and, means for connecting the other of the terminals of said comparators to the different ones of said interconnection points, the comparators associated with the outer most interconnection points being connected to drive said alarm indication providing means and the comparators connected to the inner most interconnection points being connected to drive said indicating device, each of said comparators having a feedback resistor connected from the output thereof to the input terminal connected to said node, the resistive elements of said second voltage dividing network having values such that comparators which drive said alarm indication providing means are less sensitive to voltage changes at said predetermined node than are the comparators which drive said indication device, whereby the voltage at said node may be adjusted precisely in accordance with the output from said inner comparators and whereby said outer comparators are thereby appropriately set with hysteresis about a point set in response to the indication from said inner comparators.

* * * * *